US008768217B2

(12) United States Patent
Yagata et al.

(10) Patent No.: US 8,768,217 B2
(45) Date of Patent: Jul. 1, 2014

(54) DRIVE AND IMAGE FORMING APPARATUS

(75) Inventors: Kazuyuki Yagata, Kanagawa (JP); Yoshihiro Enomoto, Kanagawa (JP); Akihiro Ouchi, Kanagawa (JP); Kenji Suzuki, Kanagawa (JP); Yoshiya Mashimo, Kanagawa (JP); Shinichi Kanaya, Kanagawa (JP); Mitsuaki Kuroda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 325 days.

(21) Appl. No.: 13/364,162

(22) Filed: Feb. 1, 2012

(65) Prior Publication Data

US 2013/0051871 A1 Feb. 28, 2013

(30) Foreign Application Priority Data

Aug. 26, 2011 (JP) ..... 2011-184331

(51) Int. Cl.
*G03G 15/00* (2006.01)

(52) U.S. Cl.
CPC ..... *G03G 15/757* (2013.01); *G03G 2221/1657* (2013.01)
USPC ..... 399/167

(58) Field of Classification Search
CPC ..... G03G 15/757; G03G 2221/1657
USPC ..... 399/167, 302
See application file for complete search history.

(56) References Cited

U.S. PATENT DOCUMENTS 7,469,115 B2 * 12/2008 Suzuki ..... 399/111
2013/0223894 A1 * 8/2013 Ouchi et al. ..... 399/302

FOREIGN PATENT DOCUMENTS

WO 2005-309060 A 11/2005

* cited by examiner

*Primary Examiner* — Walter L Lindsay, Jr.
*Assistant Examiner* — Rodney Bonnette
(74) *Attorney, Agent, or Firm* — Sughrue Mion, PLLC

(57) ABSTRACT

A drive includes a driving shaft that includes a distal end portion having a screw hole at a distal end and being inserted into a hollow portion from a first end of a driving roller in a rotation-axis direction, and that transmits a rotational driving force to the driving roller through a fit portion; a spring washer arranged at a second end of the driving roller opposite to the first end in the rotation-axis direction; and a screw rod that has an external thread which is screwed into the screw hole, that is inserted into the spring washer and inserted into the hollow portion from the second end, and that pinches the driving roller between the screw rod and the fit portion of the driving shaft in the rotation-axis direction through the spring washer when the external thread is screwed into the screw hole.

5 Claims, 6 Drawing Sheets

DRIVE AND IMAGE FORMING APPARATUS

CROSS-REFERENCE TO RELATED APPLICATIONS

This application is based on and claims priority under 35 USC 119 from Japanese Patent Application No. 2011-184331 filed Aug. 26, 2011.

BACKGROUND (i) Technical Field

The present invention relates to a drive and an image forming apparatus.

(ii) Related Art

There is known an image forming apparatus including an intermediate transfer body that receives and provides a toner image when the toner image formed on an image bearing body is transferred on a recording medium, and also there is known a drive that is mounted in the image forming apparatus and drives the intermediate transfer body.

SUMMARY

According to an aspect of the invention, there is provided a drive including a driving roller that has a hollow portion penetrating through the driving roller in a rotation-axis direction and that drives a driven body by rotation of the driving roller; a driving shaft that includes a distal end portion having a screw hole at a distal end of the distal end portion and being inserted into the hollow portion from a first end of the driving roller in the rotation-axis direction, and a fit portion being fitted to the first end of the driving roller while the distal end portion is inserted into the hollow portion, and that transmits a rotational driving force to the driving roller through the fit portion; a spring washer arranged at a second end of the driving roller opposite to the first end in the rotation-axis direction; a screw rod that has at a distal end of the screw rod an external thread which is screwed into the screw hole, that is inserted into the spring washer at the second end and inserted into the hollow portion from the second end, and that pinches the driving roller between the screw rod and the fit portion of the driving shaft in the rotation-axis direction through the spring washer when the external thread is screwed into the screw hole formed at the distal end of the distal end portion inserted into the hollow portion from the first end; and a driving source that rotates the driving shaft.

BRIEF DESCRIPTION OF THE DRAWINGS

Exemplary embodiment(s) of the present invention will be described in detail based on the following figures, wherein.

DETAILED DESCRIPTION

An exemplary embodiment of the invention will be described below.

Figure 1:
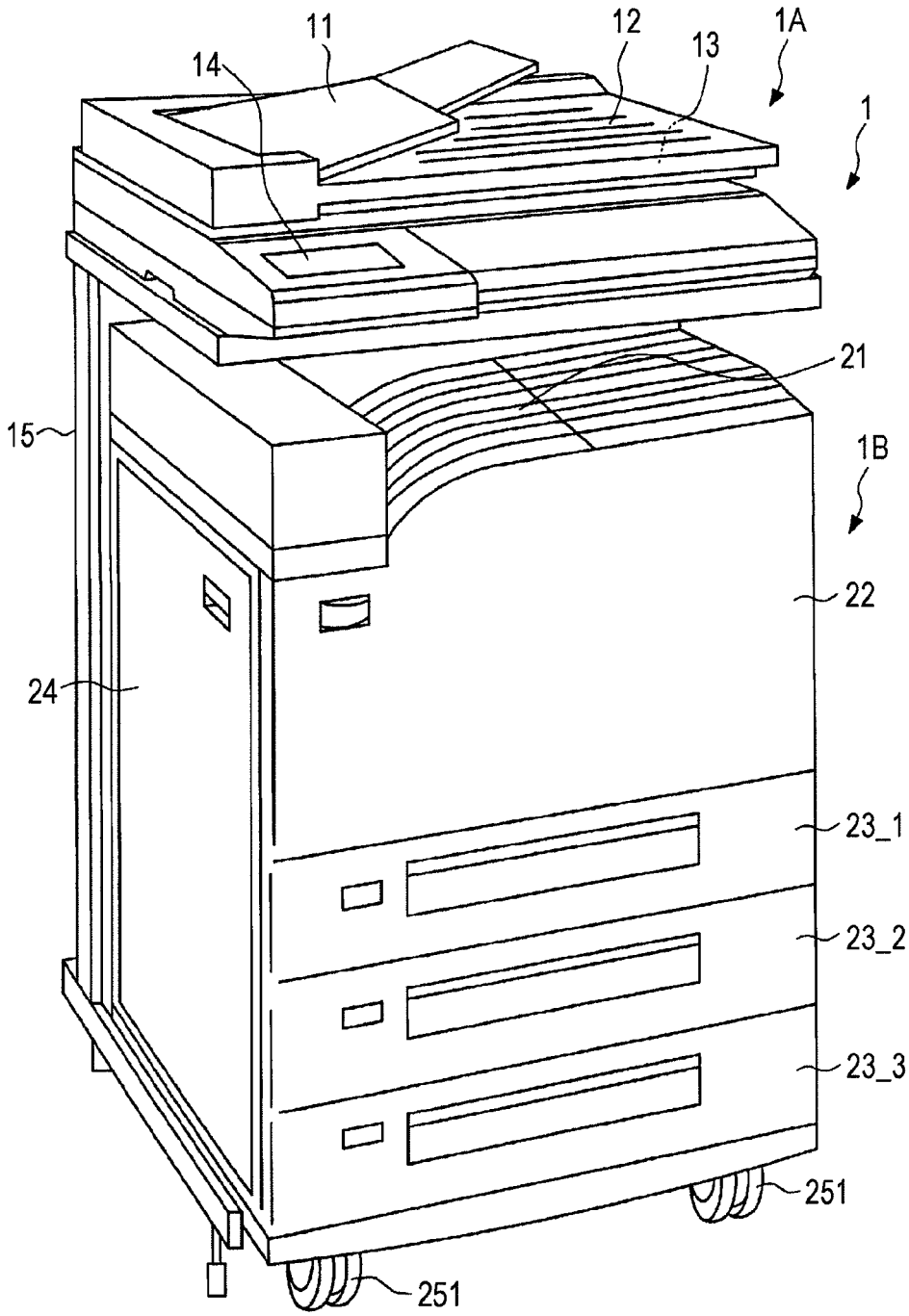
FIG. 1 is an external perspective view of a copier as an example of an image forming apparatus.

FIG. 1 is an external perspective view of a copier as an example of an image forming apparatus.

A copier 1 includes a document reading section 1A and an image forming section 1B.

The document reading section 1A includes a document feed tray 11 on which documents are placed in a stacked manner. The documents placed on the document feed tray 11 are fed one by one, a character or an image recorded on the documents is read, and then the documents are output onto a document output tray 12.

The document reading section 1A has a horizontally extending hinge at a far side. The document feed tray 11 and the document output tray 12 may be lifted together around the hinge. A document reading plate 13 (see FIG. 2) made of transparent glass is spread below the document feed tray 11 and the document output tray 12. A single document may be placed on the document reading plate 13 with a surface to be copied facing downward, instead of that a document is placed on the document feed tray 11, and the document reading section 1A may read a character or an image from the document on the document reading plate 13.

A display operation unit 14 is provided at the front of the document reading plate 13. The display operation unit 14 displays various messages for a user and displays various operation buttons to receive an operation such as an instruction for image reading and an instruction for image formation from the user.

The document reading section 1A is entirely supported by a support frame 15.

The image forming section 1B includes a sheet output tray 21. A sheet with an image formed on an upper surface of the sheet is output onto the sheet output tray 21. A front cover 22 is provided at a front surface of the image forming section 1B. The front cover 22 is opened when a part such as a toner container is replaced or when a paper jam occurring during transportation is cleared. Also, three drawer-type sheet feed trays 23_1, 23_2, and 23_3 are housed below the front cover 22. Sheets before image formation are housed in the sheet feed trays 23_1, 23_2, and 23_3 in a stacked manner.

A side cover 24 is provided at a left surface of the image forming section 1B. The side cover 24 is opened when a paper jam occurring during transportation is cleared.

Further, wheels 251 are attached to a bottom surface of the image forming section 1B. The wheels 251 make the image forming section 1B movable.

Figure 2:
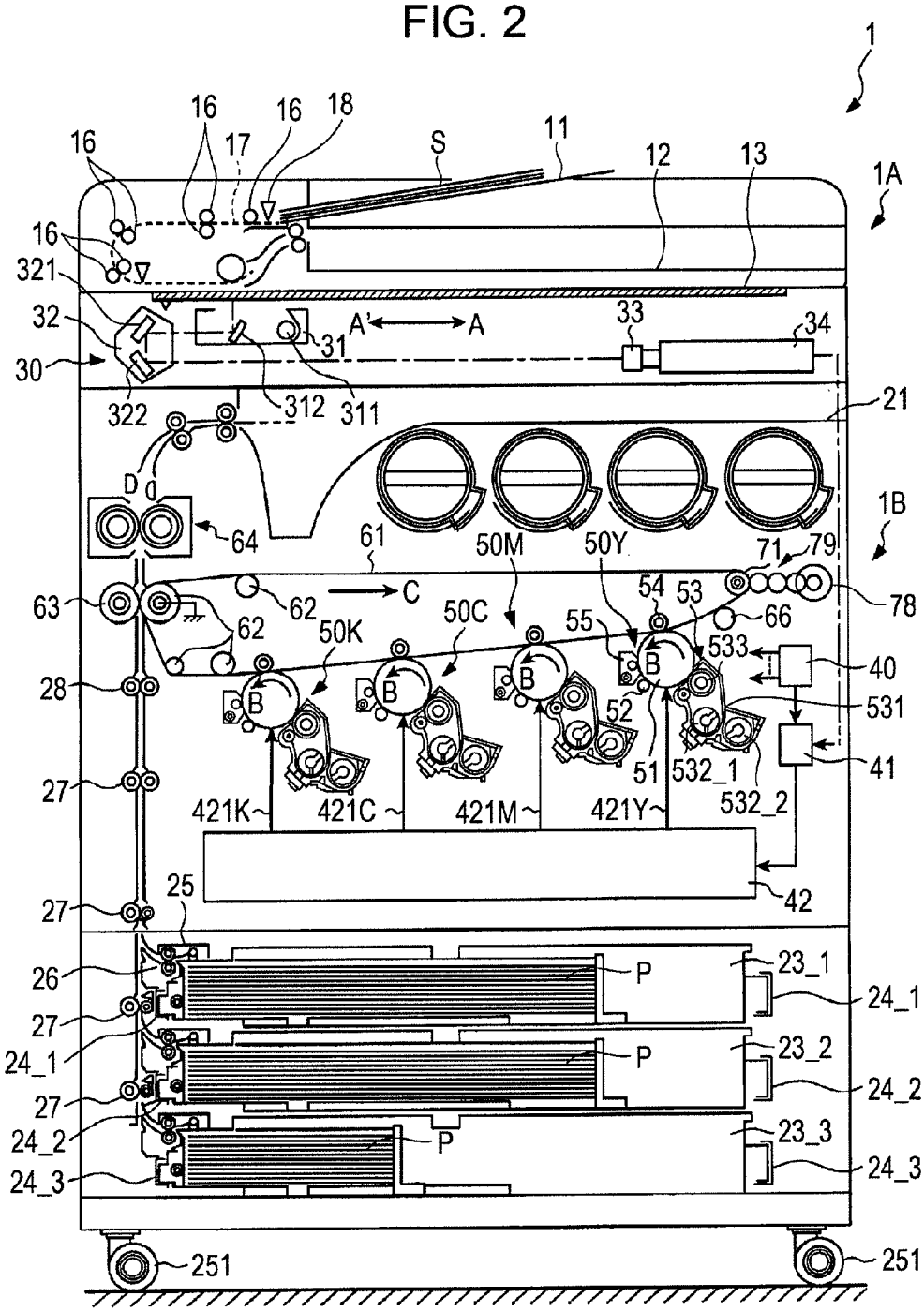
FIG. 2 is an interior configuration diagram of the copier the exterior of which is shown in FIG. 1.

FIG. 2 is an interior configuration diagram of the copier the exterior of which is shown in FIG. 1;

A document reading optical system 30 is arranged below the document reading plate 13 made of transparent glass. The document reading optical system 30 includes a first block 31, a second block 32, and a photoelectric sensor 33. The first block 31 has a lamp 311 and a mirror 312. The second block 32 includes two mirrors 321 and 322. The photoelectric sensor 33 reads light representing an image and generates an image signal.

The first block 31 and the second block 32 are movable in directions indicated by arrows A-A' along the document reading plate 13. In an initial state, the first block 31 and the second block 32 are located at a left position shown in FIG. 2.

Documents S placed on the document feed tray 11 are fed one by one and transported in a transport path 17 that is in contact with the document reading plate 13 by transport rollers 16. The lamp 311 radiates each document S with light when the document S is transported while being in contact with the document reading plate 13. Reflected light from the document S is reflected by the mirrors 312, 321, and 322. The photoelectric sensor 33 reads the reflected light. The photoelectric sensor 33 generates an image signal representing a character or an image recorded on the document S. The document S after radiation by the lamp 311 is further transported onto the document output tray 12.

When a document is placed on the document reading plate 13, the first block 31 and the second block 32 move in the direction indicated by the arrow A such that the optical distance between a reading position of the document on the document reading plate 13 and the photoelectric sensor 33 is kept constant. During the movement, the lamp 311 radiates the document with light, and the photoelectric sensor 33 reads a character or an image on the document and converts the character or the image into image signals.

The image signals acquired by the photoelectric sensor 33 are input to an image processor 34. The image signals acquired by the photoelectric sensor 33 are image signals representing respective colors including red (R), green (G), and blue (B). The image processor 34 converts the RGB image signals into image data of four colors including yellow (Y), magenta (M), cyan (C), and black (K), and temporarily stores the image data. The YMCK image data is transmitted to an exposure controller 41 at a timing of exposure for formation of a latent image (described later).

The image forming section 1B includes an exposure unit 42. When a latent image is formed, the image data of Y, M, C, and K is transmitted from the exposure controller 41 to the exposure unit 42. The exposure unit 42 emits exposure light beams 421Y, 421M, 421C, and 421K that are modulated respectively in accordance with the image data of Y, M, C, and K.

Also, referring to FIG. 2, a main controller 40 is arranged at a position next to the exposure controller 41. The main controller 40 includes a microcomputer and a program executed by the microcomputer. The main controller 40 is connected with the exposure controller 41, the display operation unit 14 (see FIG. 1), the image processor 34, and other power supply circuit and driving circuit (not shown), and provides control for the entire copier 1.

The above-described three sheet feed trays 23_1, 23_2, and 23_3 are housed in a lower portion of the image forming section 1B and supported by left and right guide rails 24_1, 24_2, and 24_3. Sheets P are housed in a stacked manner in each of the sheet feed trays 23_1, 23_2, and 23_3. The sheet feed trays 23_1, 23_2, and 23_3 may be pulled out while being guided by the guide rails 24_1, 24_2, and 24_3 for supply of sheets P.

Sheets P are fed by a pickup roller 25 from a sheet feed tray designated by an operation or the like of the display operation unit 14 (see FIG. 1) from among the three sheet feed trays 23_1, 23_2, and 23_3 (in this case, for example, sheets P are fed from the sheet feed tray 23_1). The sheets P are separated one by one by separation rollers 26 and the separated single sheet P is transported upward by a transport roller 27. A holding roller 28 adjusts the timing of transportation of the sheet P in a path arranged downstream of the holding roller 28. Then, the sheet P is further transported upward. The transportation of the sheet P in the path arranged downstream of the holding roller 28 will be described later.

Four image forming units 50Y, 50M, 50C, and 50K that form toner images with the toners of the respective colors including Y, M, C, and K are arranged in a center portion of the image forming section 1B. The four image forming units 50Y, 50M, 50C, and 50K have equivalent configurations except that the colors of the toners to be used are different. Hence, the configuration of the Y-color image forming unit 50Y is representatively described here.

The image forming unit 50Y includes a photoconductor 51 that rotates in a direction indicated by an arrow B in FIG. 2. A charging device 52, a developing device 53, and a cleaner 55 are arranged around the photoconductor 51. Also, a transfer member 54 is arranged at a position at which an intermediate transfer body 61 (described later) is arranged between the transfer member 54 and the photoconductor 51.

The photoconductor 51 has a cylindrical shape, holds an electric charge by charging, emits the electric charge by exposure, and holds an electrostatic latent image on a surface of the photoconductor 51.

The charging device 52 charges the surface of the photoconductor 51 with electricity with a certain charge potential.

The image forming section 1B also includes the exposure unit 42 described above. The exposure unit 42 receives the image signals input from the exposure controller 41, and outputs the exposure light beams 421Y, 421M, 421C, and 421K that are modulated in accordance with the input image signals. The photoconductor 51 is charged with electricity by the charging device 52, and then is radiated with the exposure light beam 421Y from the exposure unit 42. Thus, an electrostatic latent image is formed on the surface of the photoconductor 51.

After the electrostatic latent image is formed on the surface of the photoconductor 51 as the result of the radiation with the exposure light beam 421Y, the electrostatic latent image is developed by the developing device 53, and a toner image (in this image forming unit 50Y, a toner image with a toner of yellow (Y)) is formed on the surface of the photoconductor 51.

The developing device 53 includes a case 531 that contains a developer formed of a toner and a carrier therein, two augers 532_1 and 532_2 that stir the developer, and a developing roller 533 that conveys the developer to a position at which the developing roller 533 faces the photoconductor 51. The augers 532_1 and 532_2 and the developing roller 533 are arranged in the case 531. When the electrostatic latent image formed on the photoconductor 51 is developed, a bias voltage is applied to the developing roller 533. The toner in the developer adheres to the electrostatic latent image formed on the photoconductor 51 by the action of the bias voltage, and thus a toner image is formed.

The toner image formed on the photoconductor 51 through the development by the developing device 53 is transferred onto the intermediate transfer body 61 by the action of the transfer member 54.

The cleaner 55 removes the toner remaining on the photoconductor 51 after the transfer.

The intermediate transfer body 61 is an endless belt that is wound around a driving roller 71 and other plural rollers 62, is driven by rotation of the driving roller 71, and hence circulates in a direction indicated by an arrow C.

The image forming section 1B includes a transfer member 63 that transfers a toner image on the intermediate transfer belt 61 onto a sheet, and a fixing device 64 that fixes the toner image transferred on the sheet to the sheet by applying heat and pressure to the toner image.

Figure 3:
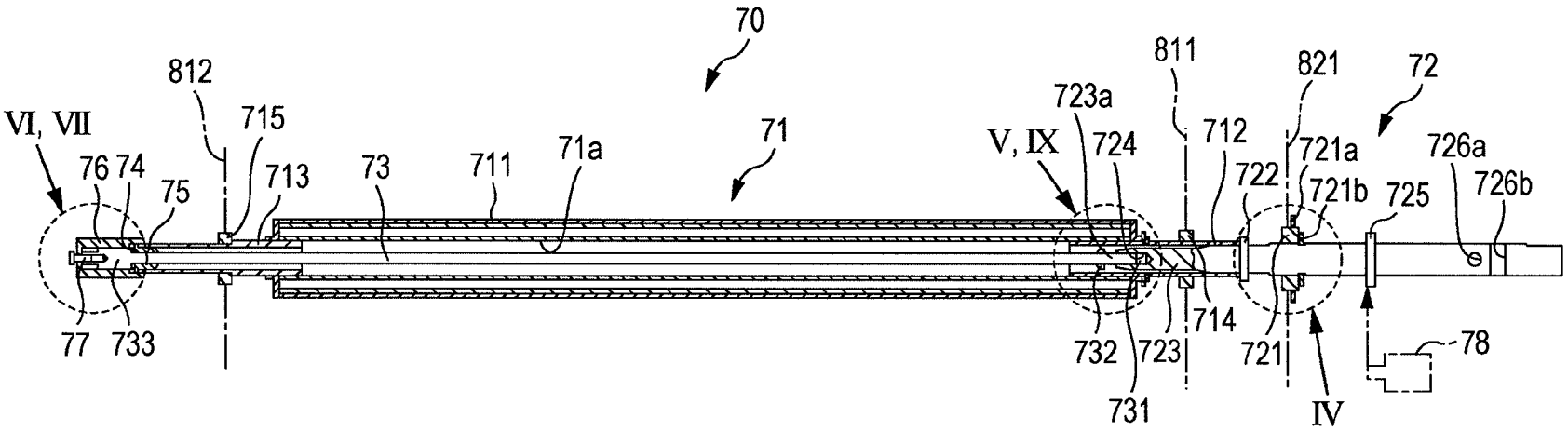
FIG. 3 is a sectional view on a plane including a rotation axis showing an assembly of a driving roller and a driving shaft that drives the driving roller, which form a drive that drives an intermediate transfer body.

The driving roller 71 is rotationally driven by a motor 78 as a driving source through a gear train 79 and a driving shaft 72 (see FIG. 3).

The intermediate transfer body 61, the driving roller 71, and other plural rollers 62 form an intermediate transfer unit. The intermediate transfer unit may be pulled forward (in a direction perpendicular to the sheet of FIG. 2) from a body of the image forming section 1B for maintenance and may be housed in the body as a unit. This exemplary embodiment has a feature particularly for a structure around the driving roller 71 that forms the intermediate transfer unit. The details will be described later.

FIG. 3 is a sectional view on a plane including a rotation axis showing an assembly of a driving roller and a driving shaft that drives the driving roller, which form a drive that drives an intermediate transfer body.

FIG. 3 illustrates an assembly 70 in a state in which the driving roller 71 is coupled with the driving shaft 72. A side near the driving shaft 72 (right side in FIG. 3) is a side near a rear surface of the copier shown in FIGS. 1 and 2, and a side near the driving roller 71 (left side in FIG. 3) is a side near a front surface of the copier.

The driving roller 71 is a member that drives a driven body (in the example of the copier 1 shown in FIGS. 1 and 2, the intermediate transfer body 61). The driving roller 71 includes a driving unit 711 that is directly in contact with the intermediate transfer body 61 and causes the intermediate transfer body 61 to circulate; and a pair of support portions 712 and 713 arranged at the front and rear of the driving unit 711 and fixed to the driving unit 711. Also, the driving roller 71 has a hollow portion 71*a* penetrating through the driving unit 711 and the pair of support portions 712 and 713 in a rotation-axis direction (left-right direction in FIG. 2). Bearings 714 and 715 are respectively supported at the pair of support portions 712 and 713. The pair of support portions 712 and 713 are supported by frames 811 and 812 of the intermediate transfer unit through the bearings 714 and 715.

In addition, a bearing 721 is supported at the driving shaft 72.

Figure 4:
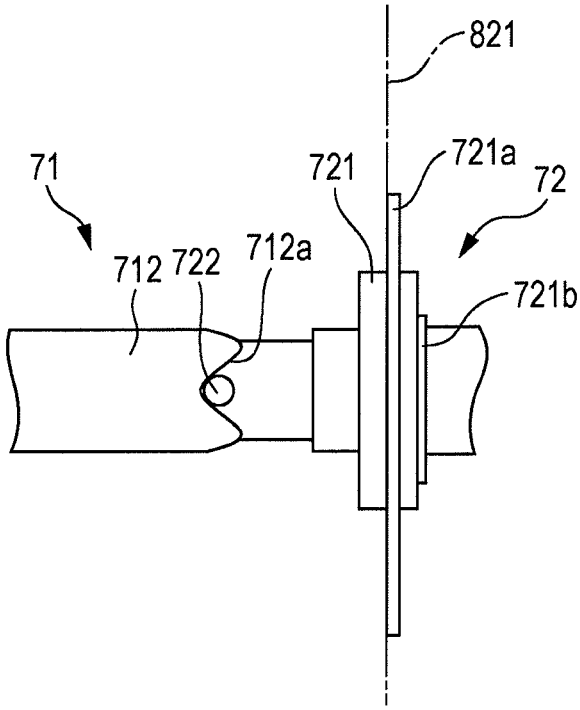
FIG. 4 is an enlarged view of a portion indicated by a circle IV in FIG. 3.

FIG. 4 is an enlarged view of a portion indicated by a circle IV in FIG. 3. FIG. 4 is not a sectional view, but illustrates an appearance of a portion indicated by the circle IV in FIG. 3 in a view in an extending direction of a driving pin 722 (described later, also see FIG. 3) (in a direction orthogonal to the direction shown in FIG. 3).

The bearing 721 supported at the driving shaft 72 is fixed to the driving shaft 72 by a fixing mechanism including an E-ring 721*b* while a sheet-metal member 721*a* is fixed to the bearing 721. The bearing 721 is rotatably supported by a frame 821 of the image forming section 1B of the copier 1 (see FIGS. 1 and 2) through the sheet-metal member 721*a*. The driving pin 722 is provided in a fixed manner at the driving shaft 72. The driving pin 722 is fitted to a groove 712*a* that is formed at a distal end of the support portion 712 provided at the side of the driving roller 71 near the driving shaft 72. When the driving shaft 72 is rotated, a rotational driving force of the driving shaft 72 is transmitted to the driving roller 71 through the driving pin 722, the driving roller 71 is rotated, and hence the intermediate transfer body 61 (see FIG. 2) circulates. The driving pin 722 is an example of a fit portion.

The rigidity of a peripheral portion of the driving pin 722 of the driving shaft 72, i.e., a fit portion with respect to the driving roller 71 is increased by high-frequency quenching. Thus, this portion is prevented form wearing.

As shown in FIG. 3, a distal end portion 723 of the driving shaft 72 at the left with respect to the driving pin 722 is inserted into the hollow portion 71*a* of the driving roller 71 from a rear end of the hollow portion 71*a*. Further, a pin 725 is fixed at the rear side of the driving shaft 72 with respect to the bearing 721. A last gear (not shown) of the gear train (see FIG. 2) that receives transmission of the driving force from a motor 78 as the driving source is attached to the pin 725. The driving shaft 72 receives the rotational driving force from the motor 78 through the portion of the pin 725. Further, two screw holes 726*a* and 726*b* that are perpendicular to the rotation axis and perpendicular to each other are formed at a rearmost portion of the driving shaft 72. A flywheel (not shown) that smoothens rotation of the driving shaft 72 is attached to the screw holes 726*a* and 726*b*.

Figure 5:
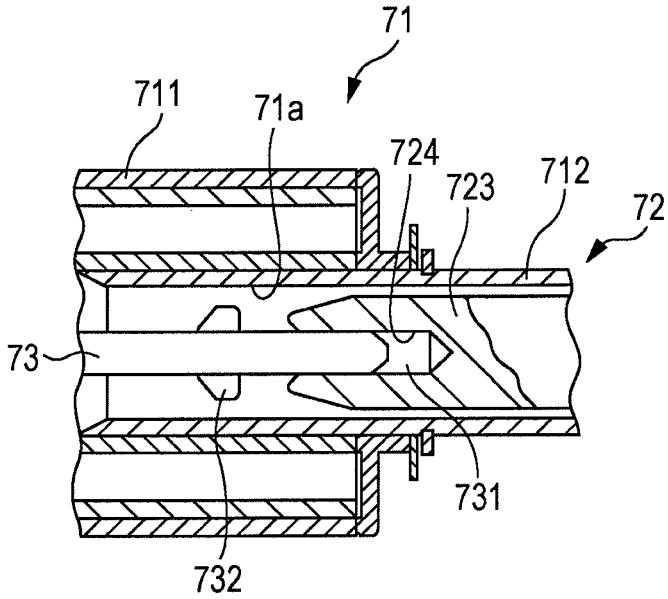
FIG. 5 is an enlarged view of a portion indicated by a circle V in FIG. 3.

FIG. 5 is an enlarged view of a portion indicated by a circle V in FIG. 3.

FIG. 5 illustrates the distal end portion 723 of the driving shaft 72, the distal end portion 723 which is inserted into the hollow portion 71*a* of the driving roller 71. A screw hole 724 is formed at a distal end of the distal end portion 723. An external thread 731 formed at a distal end of a screw rod 73 is screwed into a screw hole 724. The screw rod 73 is a metal rod that is inserted into the hollow portion 71*a* of the driving roller 71 from a front end of the driving roller 71.

The screw rod 73 has a ring-shaped rib 732 near the distal end at which the external thread 731 is formed. If the screw rod 73 is inserted into the hollow portion 71*a* of the driving roller 71, the screw rod 73 may be bent and the distal end portion of the screw rod 73 tends to sag. The rib 732 comes into contact with a wall surface of the hollow portion 71*a*, prevents the screw rod 73 from sagging, and guides the screw rod 73 such that the external thread 731 at the distal end is directed to the screw hole 724. The rib 732 is an example of a guide portion.

Figure 6:
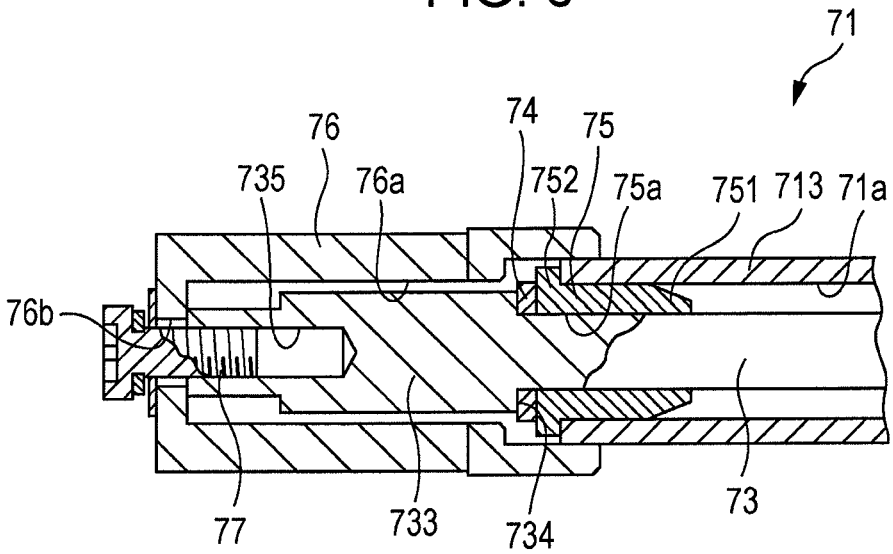
FIG. 6 is an enlarged view of a portion indicated by a circle VI in FIG. 3.

FIG. 6 is an enlarged view of a portion indicated by a circle VI in FIG. 3.

FIG. 6 illustrates a spring washer 74, a washer contact member 75, a support member 76, and a screw 77 in addition to the support portion 713 and the screw rod 73 at the front end of the driving roller 71 described above.

As described above, the screw rod 73 is inserted into the hollow portion 71*a* of the driving roller 71 from the front end of the support portion 713 at the front end forming the driving roller 71. As shown in FIGS. 3 and 5, the external thread 731 at the distal end in the insertion direction is screwed into the screw hole 724 at the distal end of the driving shaft 72. A portion of the screw rod 73 inserted into the hollow portion 71*a* has a smaller diameter than the hollow portion 71*a*, and a gap is provided therebetween. A rear end portion 733 of the screw rod 73 outside the hollow portion 71*a* has a larger diameter than the portion inserted into the hollow portion 71*a*. A step portion 734 is provided at the boundary of these portions. Also, a screw hole 735 is formed at a rear end (left end in FIG. 6) of the screw rod 73.

The washer contact member 75 includes a fit-in portion 751 that is fitted into the hollow portion 71*a*, and a flange portion 752 that extends in a radial direction with respect to the fit-in portion 751 and is pressed to a front end portion of the hollow portion 71*a*. The washer contact member 75 also has a hole 75*a*. The screw rod 73 passes through the hole 75*a*. The washer contact member 75 is a member that pinches the spring washer 74 between the washer contact member 75 and the step portion 734 of the screw rod 73.

In this exemplary embodiment, the diameter of the hollow portion 71*a* markedly differs from the diameter of the portion of the screw rod 73 inserted into the hollow portion 71*a*, and a large gap is present therebetween. Thus, the washer contact member 75 is provided. However, if the spring washer 74 may be directly pinched between the end surface of the driving roller 71 (the support portion 713 of the driving roller 71) and the screw rod 73, the washer contact member 75 may be omitted.

Also, as shown in FIG. 6, the support member 76 has an angular C-shaped cross section, and has a hollow portion 76*a* that houses the spring washer 74 and the rear end portion 733 of the screw rod 73.

The support member 76 also has a hole 76*b*. The screw 77 is inserted into the hole 76*b*. The support member 76 is a member that works in association with the screw 77 of the support member 76 and supports the rear end portion 733 of the screw rod 73, which is adjacent to the spring washer 74, non-rotatably relative to the driving roller 71.

Figure 7:
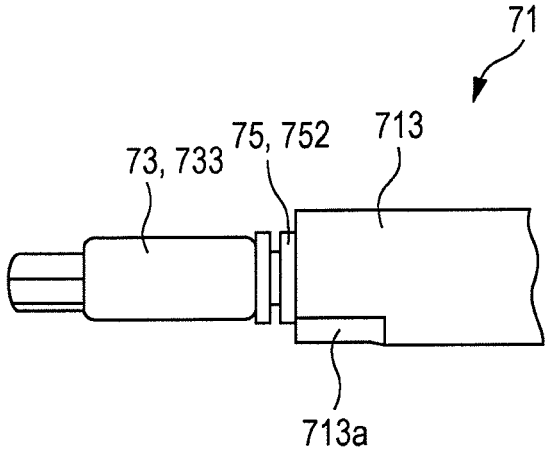
FIG. 7 is an external view showing a portion indicated by a circle VII in FIG. 3 when a support member and a screw are removed.

FIG. 7 is an external view showing a portion indicated by a circle VII in FIG. 3 when the support member and the screw are removed.

Figure 8:
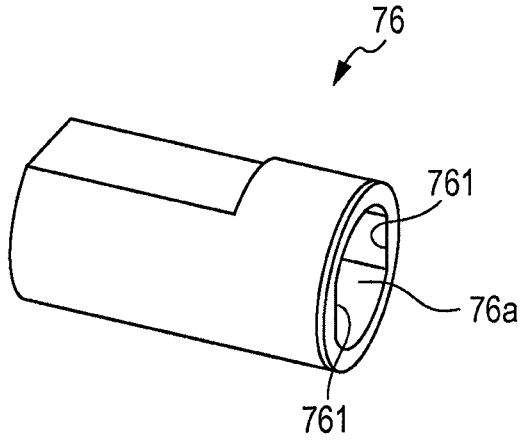
FIG. 8 is an external view of the support member.

FIG. 8 is an external view of the support member.

As shown in FIG. 7, the support portion 713 of the driving roller 71 has a D-cut portion 713*a* that is cut in the form of a flat surface at an outer peripheral surface of the support portion 713. The D-cut portion 713*a* is formed at only a single position in FIG. 7; however, the D-cut portion 713*a* is also formed at a position 180°-different from the former position in a rotating direction of the driving roller 71. Also, as shown in FIG. 8, the support member 76 has a flat surface portion 761 formed such that a wall surface of the hollow portion 76*a* is partly a flat surface. Flat surface portions 761 are formed at two positions differ from each other by 180° in the rotating direction. The interval between the flat surface portions 761 is equivalent to the interval between the D-cut portions 713*a* of the support portion 713 of the driving roller 71.

As shown in FIG. 6, the support member 76 is attached to cover the end portion of the support portion 713 of the driving roller 71. At this time, the support member 76 is attached such that the flat surface portions 761 of the support member 76 face the D-cut portions 713*a* of the support portion 713 of the driving roller 71. Hence, the support member 76 is prevented from being rotated relative to the driving roller 71. Also, the rear end portion 733 of the screw rod 73 is screwed to the support member 76 by the screw 77. Hence, the rear end portion 733 of the screw rod 73 is fixed non-rotatably relative to the driving roller 71.

As described above, referring to FIGS. 3 and 5, the external thread 731 at the distal end of the screw rod 73 is screwed to the screw hole 724 at the distal end of the distal end portion 723 of the driving shaft 72. Also, referring to FIG. 4, the driving pin 722 of the driving shaft 72 is inserted into the groove 712*a* at the rear end portion of the driving roller 71. In particular, the driving roller 71 is supported by the driving pin 722 of the driving shaft 72 and the rear end portion 733 (see FIG. 6) of the screw rod 73, from both sides in the longitudinal direction through the spring washer 74, in a pinched manner in a rotation-axis direction.

In this exemplary embodiment, since the driving roller 71 is pinched through the spring washer 74, even if the dimension of the driving roller 71 is changed with temperature relative to the dimension of the screw rod 73, the change is absorbed by the spring washer 74. If the spring washer 74 is not arranged, the fastened state between the driving shaft 72 and the screw rod 73 may be loosened when the dimensions are frequently changed with temperature. However, in this exemplary embodiment, since the spring washer 74 is arranged, loosening is prevented from occurring.

Also, in this exemplary embodiment, the screw rod 73 is fixed relatively non-rotatably by using the support member 76. Hence, the screw is reliably prevented from being loosened.

Figure 9:
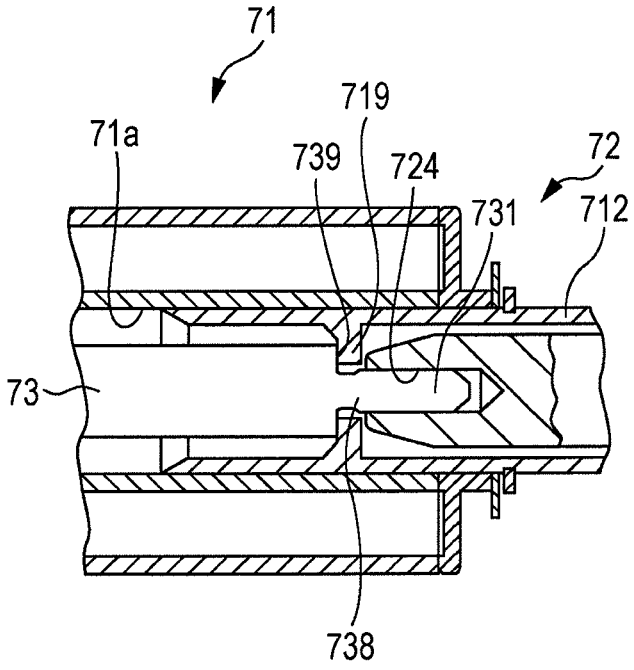
FIG. 9 is a sectional view showing a portion corresponding to a circle IX in FIG. 3 according to a comparative example.

FIG. 9 is a sectional view showing a portion corresponding to a circle IX in FIG. 3 according to a comparative example.

FIG. 9 corresponds to FIG. 5 according to this exemplary embodiment. In this comparative example shown in FIG. 9, for easier understanding, components of the comparative example corresponding to components of the exemplary embodiment refer reference signs equivalent to the reference signs provided in the figures illustrating the exemplary embodiment.

A hollow portion 71*a* of a driving roller 71 of the comparative example has a ring-shaped rib 719 protruding inward. In contrast, a screw rod 73 inserted into the hollow portion 71*a* has a wall portion 739 at a position adjacent to an external thread 731 at a distal end. The screw rod 73 is in a state in which the external thread 731 is screwed into a screw hole 724 at a distal end of a driving shaft 72 and the wall portion 739 is in contact with the ring-shaped rib 719. In the exemplary embodiment, as described above, the driving pin 722 (see FIG. 4) of the driving shaft 72 and the rear end portion 733 (see FIG. 6) of the screw rod 73 pinch both ends of the driving roller 71 in the rotation-axis direction. In contrast, according to the comparative example shown in FIG. 9, a driving pin 722 of the driving shaft 72 (see FIGS. 3 and 4) and the wall portion 739 near the distal end of the screw rod 73 pinch a support portion 712 at the rear end of the driving roller 71. With the structure of the comparative example, the wall portion 739 near the external thread 731 is almost fixed by the ring-shaped rib 719. Hence, if the rotation axis of the screw rod 73 is inclined to the rotation axis of the driving shaft 72 although the inclination is very small or if these rotation axes are parallel to each other but the rotation axes are shifted from each other, the external thread 731 of the screw rod 73 frequently receives a force by the rotation of the driving shaft 72 etc., a screw neck 738 surrounded by the ring-shaped rib 719 of the screw rod 73 or a valley portion of spiral tops and valleys of the external thread 731 may be likely broken.

In contrast, according to the exemplary embodiment, the external thread 731 is largely separated from the step portion 734 (see FIG. 6) of the screw rod 73 by a distance that is as substantially large as the length of the driving roller 71. Even if an inclination or a parallel shift is present between the rotation axes of the driving shaft 72 and the screw rod 73, the inclination or parallel shift is absorbed even when the screw rod 73 is very slightly bent, a defect such as breakage according to the comparative example does not occur, and hence reliability is increased.

When the intermediate transfer unit including the assembly 70 (see FIG. 3) and the intermediate transfer body (see FIG. 2) is pulled out from the front (left side in FIG. 3) of the body of the image forming section 1B of the copier 1 for maintenance, the following procedure is taken. First, the screw 77 that fixes the screw rod 73 is removed, and the support member 76 is detached. Then, the screw rod 73 is rotated, and the external thread 731 at the distal end of the screw rod 73 is removed from the screw hole 724. Then, the intermediate transfer unit is pulled out together with the frames 811 and 812 of the intermediate transfer unit. At this time, the driving shaft 72 remains in the image forming section 1B while the driving shaft 72 is supported by the frame 821 of the image forming section 1B.

When the intermediate transfer unit is housed, the procedure is the reverse of the procedure for pulling out.

The copier 1 shown in FIGS. 1 and 2 is described above. However, other image forming apparatus according to the present invention is not limited to the copier, and may be an image forming apparatus such as a printer or a facsimile. The drive that drives the intermediate transfer body is described above as an example of a drive according to the present invention. However, a driven member (driven body) of the drive according to the present invention is not limited to the intermediate transfer body, and any driven body may be a driving subject.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A drive comprising:

a driving roller that has a hollow portion penetrating through the driving roller in a rotation-axis direction and that drives a driven body by rotation of the driving roller;

a driving shaft that includes a distal end portion having a screw hole at a distal end of the distal end portion and being inserted into the hollow portion from a first end of the driving roller in the rotation-axis direction, and a fit portion being fitted to the first end of the driving roller while the distal end portion is inserted into the hollow portion, and that transmits a rotational driving force to the driving roller through the fit portion;

a spring washer arranged at a second end of the driving roller opposite to the first end in the rotation-axis direction;

a screw rod that has at a distal end of the screw rod an external thread which is screwed into the screw hole, that is inserted into the spring washer at the second end and inserted into the hollow portion from the second end, and that pinches the driving roller between the screw rod and the fit portion of the driving shaft in the rotation-axis direction through the spring washer when the external thread is screwed into the screw hole formed at the distal end of the distal end portion inserted into the hollow portion from the first end; and a driving source that rotates the driving shaft.

2. The drive according to claim 1, further comprising a support member that supports a portion of the screw rod adjacent to the spring washer non-rotatably relative to the driving roller.

3. The drive according to claim 1, further comprising a washer contact member that includes a fit-in portion being fitted into the hollow portion from the second end and a flange portion extending in a radial direction with respect to the fit-in portion and being pressed to the second end, that has a hole through which the screw rod passes, and that pinches the spring washer between the washer contact member and the screw rod.

4. The drive according to claim 1, wherein the screw rod includes a guide portion that extends from the screw rod in a radial direction and that guides the screw rod such that the external thread is directed to the screw hole when the screw rod is inserted into the hollow portion.

5. An image forming apparatus comprising:

a plurality of toner-image forming units that form toner images;

an intermediate transfer body that is driven to circulate along the plurality of toner-image forming units, that receives transfer of the toner images from the plurality of toner-image forming units, and that second-transfers the toner images on a recording medium;

a fixing unit that fixes the toner images on the recording medium which have received the transfer of the toner images, to the recording medium; and a driving unit that drives the intermediate transfer body, wherein the driving unit includes a driving roller that has a hollow portion penetrating through the driving roller in a rotation-axis direction and that drives the intermediate transfer body by rotation of the driving roller;

a driving shaft that includes a distal end portion having a screw hole at a distal end of the distal end portion and being inserted into the hollow portion from a first end of the driving roller in the rotation-axis direction, and a fit portion being fitted to the first end of the driving roller while the distal end portion is inserted into the hollow portion, and that transmits a rotational driving force to the driving roller through the fit portion;

a spring washer arranged at a second end of the driving roller opposite to the first end in the rotation-axis direction;

a screw rod that has at a distal end of the screw rod an external thread which is screwed into the screw hole, that is inserted into the spring washer at the second end and inserted into the hollow portion from the second end, and that pinches the driving roller between the screw rod and the fit portion of the driving shaft in the rotation-axis direction through the spring washer when the external thread is screwed into the screw hole formed at the distal end of the distal end portion inserted into the hollow portion from the first end; and a driving source that rotates the driving shaft.

* * * * *